US006421943B1

(12) United States Patent
Caulfield et al.

(10) Patent No.: US 6,421,943 B1
(45) Date of Patent: Jul. 23, 2002

(54) BIOMETRIC AUTHORIZATION AND REGISTRATION SYSTEMS AND METHODS

(75) Inventors: H. John Caulfield, Cornersville, TN (US); Ernest Halter, Huntsville, AL (US)

(73) Assignee: ID.COM, Locust Valley, NY (US)

( * ) Notice: Subject to any disclaimer, the term of this patent is extended or adjusted under 35 U.S.C. 154(b) by 0 days.

(21) Appl. No.: 09/561,464

(22) Filed: Apr. 28, 2000

(51) Int. Cl.[7] ..... F41A 17/00
(52) U.S. Cl. ..... 42/70.11; 42/70.01
(58) Field of Search ..... 42/70.01, 70.04, 42/70.05, 70.06, 70.08, 70.11

(56) References Cited

U.S. PATENT DOCUMENTS 4,970,819 A * 11/1990 Mayhak ..... 42/70.11
5,423,143 A * 6/1995 Martin ..... 42/70.01
5,502,915 A * 4/1996 Mendelsohn et al. ..... 42/70.11
6,286,242 B1 * 9/2001 Klebes ..... 42/84

* cited by examiner

*Primary Examiner*—Stephen M. Johnson
(74) *Attorney, Agent, or Firm*—Pennie & Edmonds LLP

(57) ABSTRACT

Biometric authorization and registration systems and methods are disclosed. In one embodiment, the system preferably comprises a firearm that includes a biometric authorization system, a plurality of training computers, and a server. In the preferred embodiment, the server and the training computer interact to train the biometric authorization system in the firearm to accurately and reliably discriminate between the authorized user and unauthorized users. The server utilizes a training algorithm that takes into account biometric information of not only the authorized user of firearm, but also those of a large number of unauthorized users. Such biometric information is utilized to compute one or more discriminants and thresholds for such discriminant(s), which are then transmitted to the biometric authorization system in the firearm. If the user is allowed to operate the firearm a predetermined percentage of the time, the discriminant thresholds are fixed. If not, the server adjusts the thresholds, and the process is repeated. In another aspect of the present invention, the system may be utilized to uniquely register the firearm with the authorized user. Similar training algorithms are also disclosed for training biometric authorization systems in devices other than firearms.

13 Claims, 7 Drawing Sheets

BIOMETRIC AUTHORIZATION AND REGISTRATION SYSTEMS AND METHODS

FIELD OF THE INVENTION

The present invention relates to biometric authorization and registration systems and methods.

BACKGROUND OF THE INVENTION

Everyday, thousands of authorization systems and devices attempt to determine whether a particular individual seeking access to a consumer service, a building, or operation of a device should be granted such access. Password-based authorization systems are the most prevalent, and are ubiquitously used to provide "secured" access to everything from bank accounts, to computer systems, to buildings. Password-based authorization systems suffer, however, from at least two common problems. First, the authorized user may forget his password, and thus not be able to access whatever he has been given the right to access. More problematically, unauthorized users may fraudulently obtain an authorized user's password information, and gain access to the supposedly secured service, space, or device.

Recognizing these and other flaws in the password-based access systems utilized today, those in the security field have turned to biometrics (the use of an individual's inherent physical or biological characteristics for identification purposes). Biometric-based security systems have thus been proposed for providing secured access to everything from computer systems to buildings. Such systems have implemented, among others, face recognition, speech recognition, and fingerprint analysis techniques.

Of particular concern today is the unauthorized use of firearms. One seems to read articles on a regular basis of stolen guns being utilized to commit crimes or young children accidentally injuring themselves or a friend with their parent's firearm. Biometric authorization systems have been proposed to solve this problem as well. For example, U.S. Pat. No. 4,467,545 to Shaw describes at a conceptual level a biometric authorization system for a handgun.

In the Shaw patent, an authorized individual's fingerprint or palm print information is stored in a recognition circuit contained in the handgun. If a would-be user's finger or palm print matches the prints stored in the recognition circuit, the firearm may be used. The Shaw system, however, will not provide acceptable "real-world" results. This is because the method chosen (attempting to match a stored print with that of a would-be user) is inadequate for the task of discriminating between the authorized user of the firearm and unauthorized users of the firearm.

Individuals may have biometric features that are common in many respects. Thus, relying on a one-to-one matching algorithm like Shaw's will almost certainly result in unauthorized individuals mistakenly being granted access to the firearm. Simply put, it would be sheer luck if the information that allows for the recognition of the desired individual is also the information that is most useful in discriminating against unauthorized users. This is because Shaw gathers and uses no information whatever about prints from anyone else.

Another authorization system for a handgun is described in U.S. Pat. No. 4,970,819 to Mayhak et al. The Mayhak system senses the grip pattern of a user by using a pressure-sensitive unit in the handle of the handgun, and uses a trained neural network to attempt to recognize an authorized user's grip pattern in order to grant access to the gun.

The Mayak system also has many disadvantages. Chief among these disadvantages is that it does not use a biometric authorization system (a system that detects an individual's inherent biological or physical characteristics), but rather attempts to detect the user's grip pattern. A user's grip pattern may change demonstrably from the time the user purchases the gun to the time that he attempts to use the gun. For example, an authorized user who attempts to use his gun in a threatening situation will in all likelihood produce a different grip pattern than the grip patterns he produced when purchasing the gun. Moreover, because the sensor in Mayhak does not detect inherent biometric features, the system will also likely suffer an unacceptable amount of false-positives (i.e., instances where the system grants unauthorized users access to the gun). This is because behavior is much more changeable than physical characteristics.

What is needed is a biometric authorization system in a firearm that can accurately and reliably authorize use of the firearm by the authorized user, while also accurately and reliably preventing the unauthorized use of the firearm. To solve this problem, the present invention utilizes a training algorithm that takes into account biometric information of not only the authorized user, but also those of a large number of unauthorized users. Such biometric information is necessary to train one or more discriminants and thresholds for such discriminant(s) that will allow the biometric authorization system to accurately and reliably discriminate between the authorized user and unauthorized users. Such a training system and method can also be utilized in biometric authorization systems in systems and devices other than firearms.

What is also needed is a system and method for uniquely registering firearms with authorized users. The present invention solves these, and many other problems.

SUMMARY OF THE INVENTION

In a preferred embodiment of the system of the present invention, the system preferably comprises a firearm that includes a biometric authorization system, a plurality of training computers, and a server. The server and the training computer interact to train the biometric authorization system in the firearm to accurately and reliably discriminate between the authorized user and unauthorized users. The server utilizes a training algorithm that takes into account biometric information of not only the authorized user of firearm, but also those of a large number of unauthorized users. Such biometric information is utilized to compute one or more discriminants and thresholds for such discriminant (s), which are then transmitted to the biometric authorization system in the firearm. If the user is allowed to operate the firearm a predetermined percentage of the time, the discriminant thresholds are fixed. If not, the server adjusts the thresholds, and the process is repeated. In another aspect of the present invention, the system may be utilized to uniquely register the firearm with the authorized user. Similar training algorithms are also disclosed for training biometric authorization systems in devices other than firearms.

DESCRIPTION OF THE PREFERRED EMBODIMENTS

Figure 1:
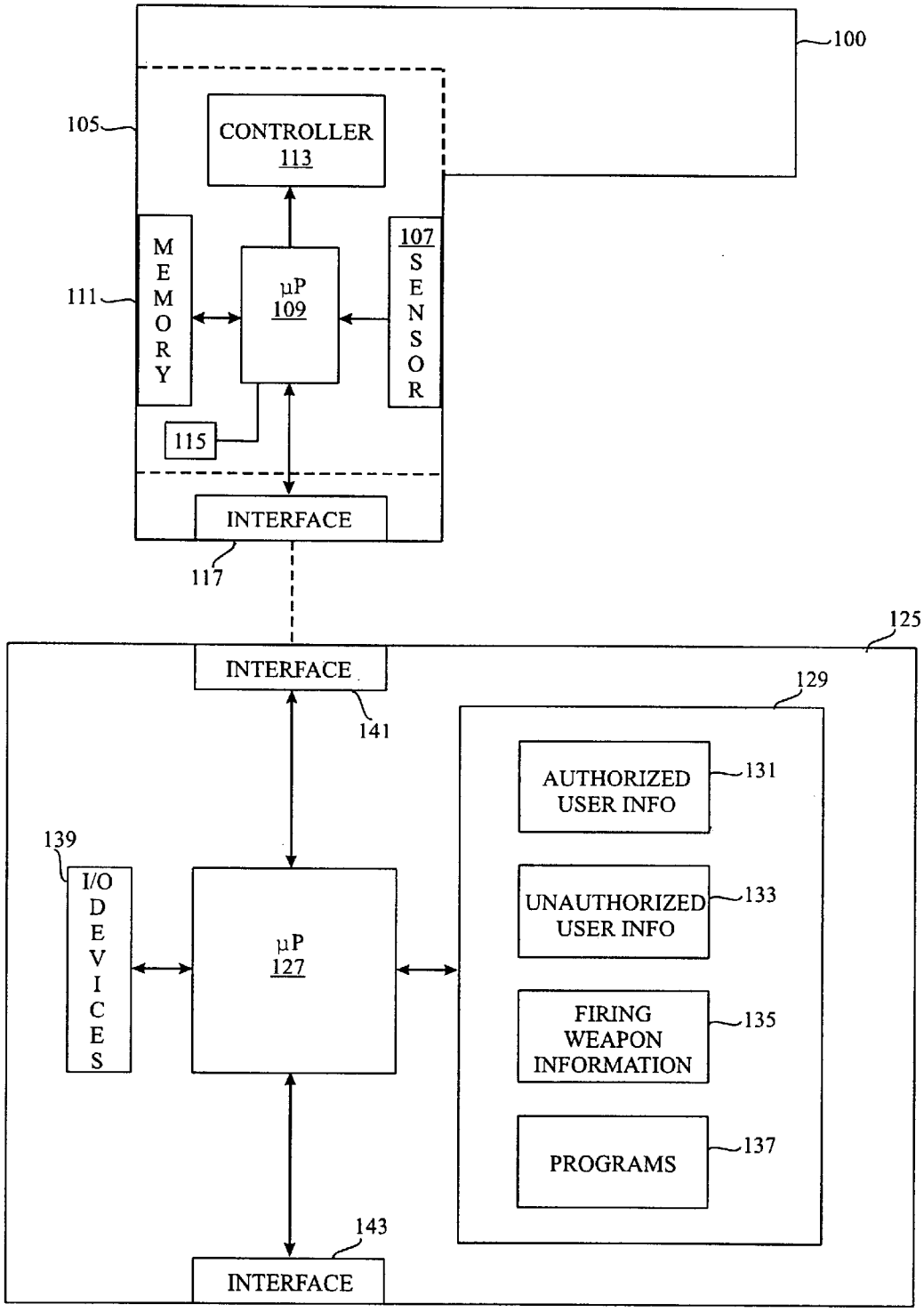
FIG. 1 is a schematic diagram illustrating a firearm having a biometric authorization system and a training computer according to one embodiment of the present invention.

With reference to FIG. 1, the system of the present invention preferably comprises a firearm 100 containing a biometric authorization system 105 and at least one training computer 125 that may be connected to the firearm 100 to allow for data transmission between the firearm and the training computer.

The biometric authorization system 105 in the firearm, when appropriately programmed according to the method of the present invention, discriminates between authorized users and unauthorized users so as prevent unauthorized users from utilizing the firearm. The biometric authorization system 105 preferably comprises a biometric sensor 107, processor 109, memory 111, controller block 113, power source 115, and communications interface block 117. The firearm also comprises standard components that are generally found in a firearm. Because these standard components are well known and form no part of the present invention, a description of such components is not provided here.

The biometric sensor 107 may be any biometric sensor capable of providing sufficient biometric information about would-be users of the firearm. In the preferred embodiment, however, an ImEdge™ sensor is utilized. This sensor uses an edge lit hologram to illuminate the portion of the user's hand grasping the handle of the firearm; i.e., the web of the user's hand. The portion of the web in contact with the hologram absorbs light from a laser diode in the sensor that illuminates the hologram. The other portions of the web allow light to fall onto a detector array in the sensor. The detector array thus detects the portions of the web not in contact with the hologram. The sensor 107 then preferably converts the detected biometric information into digital data and transmits the information to processor 109.

Processor 109 next computes (according to the trained discriminant computation algorithm stored in memory 111) one or more discriminant values based on the biometric information it receives from the sensor 107 and compares the one or more computed discriminant values against one or more discriminant thresholds stored in memory 111. Based on the comparison step, processor 109 preferably transmits a signal to controller block 113 which controls whether the firearm will be disabled or enabled.

In the preferred embodiment, controller block 113 is normally set such that the firearm may not be operated. Thus, in the preferred embodiment, the processor only sends a signal to controller block 113 if the measured biometric information indicates that the authorized user is handling the firearm. Those skilled in the art will recognize that controller block 113 may take many forms, the only limitation being that processor 109 interacts with controller block 113 so as to disable, in some way, the firearm. For example, but not by way of limitation, the controller block 113 may interact with the firearm so as to prevent the trigger of the firearm from being actuated. Alternatively, the controller block 113 may interact with the firearm so as to prevent the hammer of the firearm from being actuated. The controller block could also prevent the firearm from being loaded. There are other ways in which processor 109 could interact with the controller block 113 so as to a disable firearm, and all such mechanisms are contemplated to fall within the scope of the present invention.

The biometric authorization system 105 in the firearm is powered by power source 115, which may be any appropriate portable means of providing power to the biometric authorization system.

Firearm 100 also includes a communications interface block 117. Those skilled in the art will recognize that the interface block 117 could be any means that provides for a reliable data connection between the firearm and the training computer and/or a server computer. It may provide, e.g., for a wired or wireless connection to a communications network such as the Internet, or simply a dedicated local connection to a training computer 125.

Advantageously, once the biometric authorization system 105 has been trained, processor 109 preferably stores the last several authorized user and/or attempted (i.e., unauthorized) user web prints in memory 111. Processor 109 may also index and store in memory 111 information regarding which of such web prints resulted in the weapon being authorized and/or subsequently fired. This information could later be analyzed to assist in a crime investigation.

The training computer 125 shown in FIG. 1 serves several purposes. For instance, it may be utilized as a stand-alone unit located at a firearm dealer (or some other location) to train the biometric authorization system 105 in the firearm 100. In the preferred embodiment, however, the training computer interacts with a server computer to train the biometric authorization system 105 in the firearm. In the preferred embodiment, it also interacts with a remote server computer to uniquely register the firearm 100 with the authorized user.

If the training computer 125 is to be utilized as a stand-alone training computer, it preferably includes processor 127, memory 129, I/O devices 139, communications interface 141, and communications interface 143. In the stand-alone embodiment, memory 129 may include, for each type of firearm, authorized user web print database files 131 and unauthorized user web print data files 133. It also preferably includes firearm information 135, which preferably includes information on firearms offered for sale such as brand, type, etc. Memory 129 also includes program software 137 that allows processor 127 to operate in accordance with the present invention. Interface 141 interfaces with firearms 100, while interface 143 preferably provides an interface to a server computer.

If the training computer 125 is utilized in the more preferred embodiment along with a remote computer server, the training computer need not maintain authorized user and unauthorized user database files and a firearm database file as such files are preferably maintained at the remote server.

Figure 2:
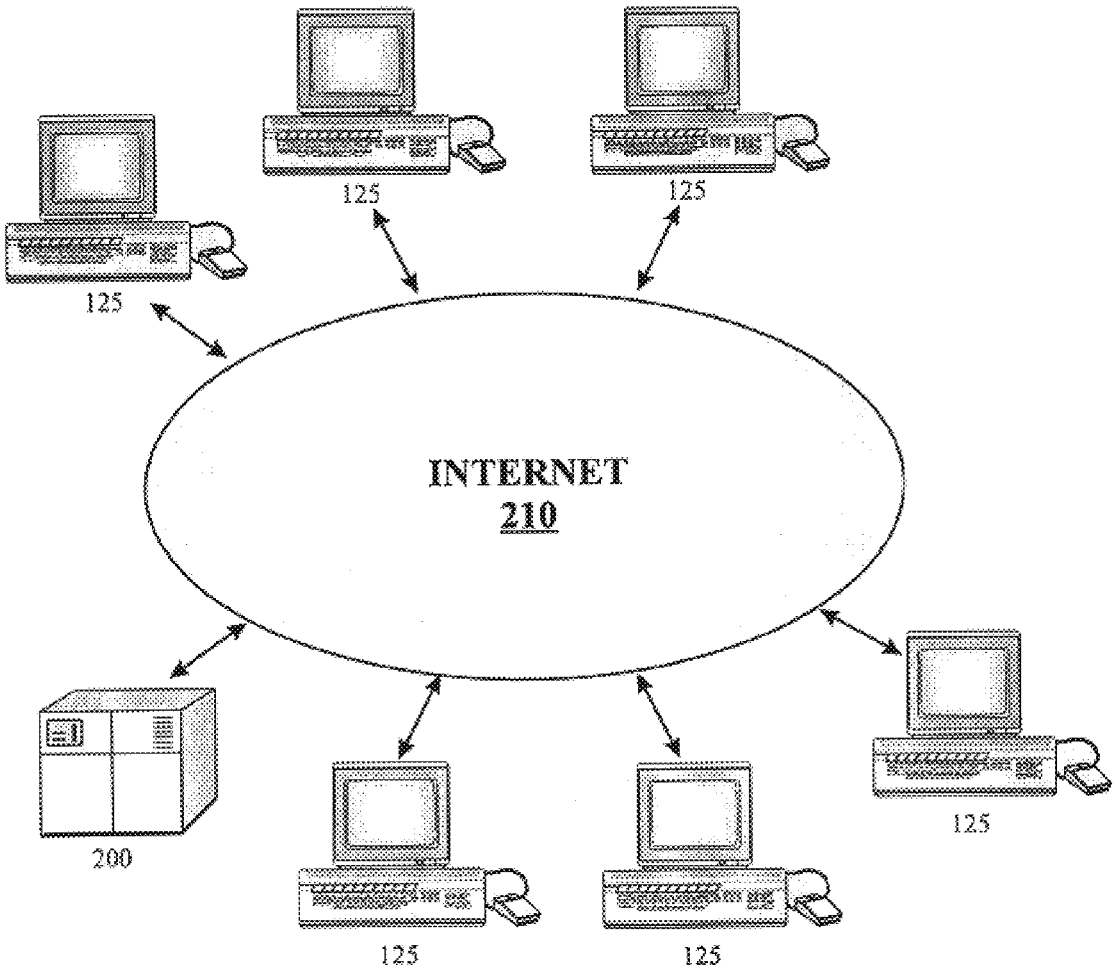
FIG. 2 is a schematic diagram illustrating an overview of the system where a plurality of training computers may access a server over a communications network.

As depicted in FIG. 2, in the preferred embodiment, a plurality of training computers 125 are connected to at least one server computer 200 via a communications network such as the Internet 210. The training computers 125 could be located at various locations remote from the server computer. For example, the training computers could be located at various firearm dealers, or at various offices of the entity administering the system of the present invention.

As indicated above, each training computer 125 may maintain databases of the authorized and unauthorized user web prints, and perform the training steps of the present invention to train the biometric authorization system 105 in firearms 100. In the preferred embodiment, however, the training computers are utilized to transmit data to and from the firearm 100 and the server computer 200 during the training of the biometric authorization system 105 in the firearm 100. They are also preferably utilized to input certain information concerning the authorized user and the firearm during the training and registration processes. In the preferred embodiment, the server computer 200 thus acts as the primary component in training the biometric authorization system 105 in the firearm 100, and in uniquely registering the firearm with the authorized user.

Figure 3:
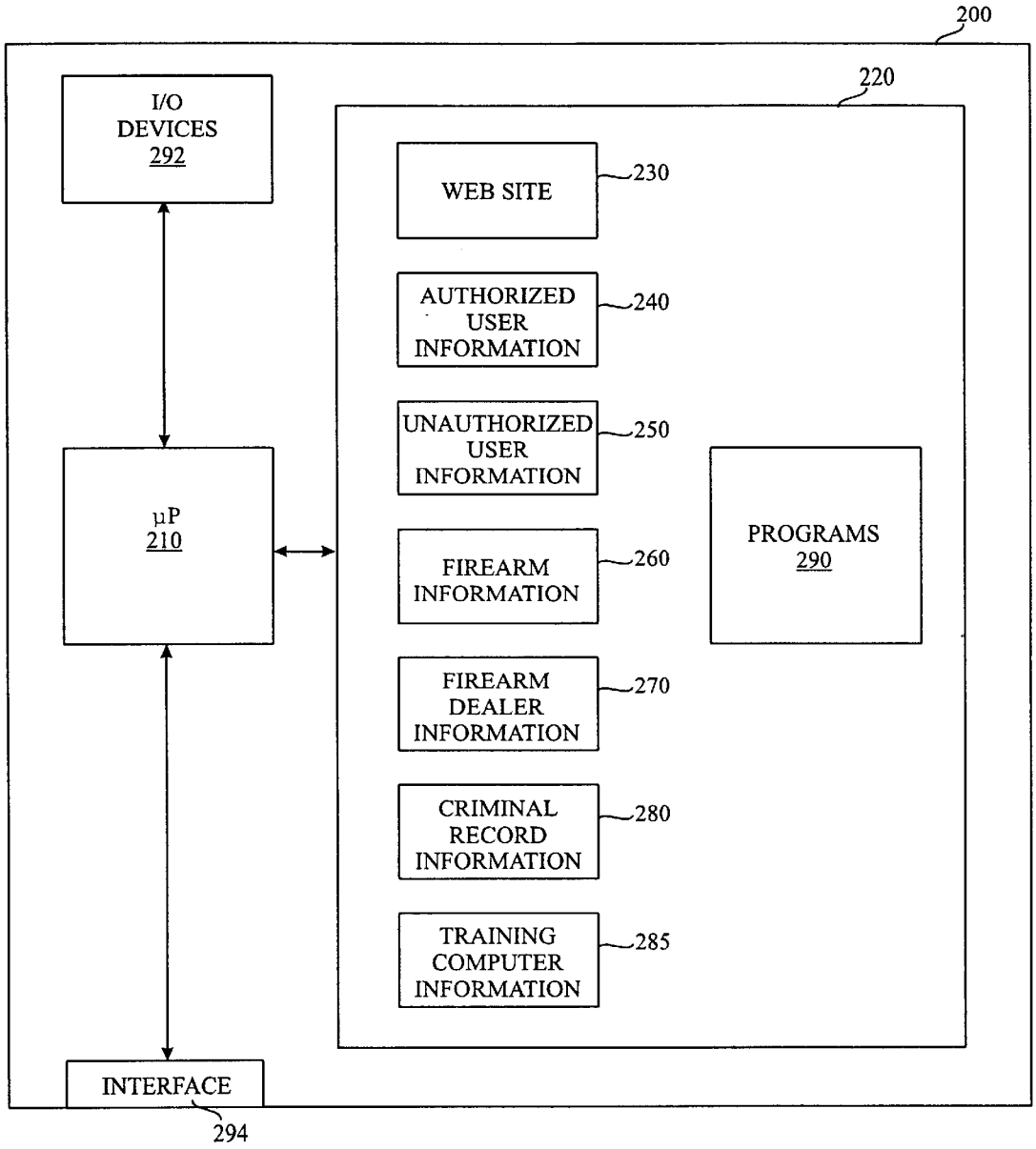
FIG. 3 is a schematic diagram illustrating a server configured in accordance with a preferred embodiment of the present invention.

With reference to FIG. 3, the server computer 200 preferably includes processor 210, memory 220, I/O devices 292, and communications interface component 294. Memory 220 preferably includes web site software 230, authorized user web prints and information 240, unauthorized user web prints 250, firearm information 260, firearm dealer information 270, criminal record information 280, training computer information 285, and programs 290 for allowing the server to operate in accordance with the present invention.

The server computer 200 is preferably administered by a governmental agency (e.g., city, county, state, federal, etc.), although it may of course be administered by any other entity. The server preferably acts as a centralized source for the training of the biometric authorization systems 105 in firearms according to the methods of the present invention, and also preferably acts as a central source for registration of the firearms according to the methods of the present invention.

The server preferably includes web site software 230 for operating a web-site (not shown) that may be accessed by the training computers 125 via a communications network such as the Internet. (Other communications networks may of course be utilized.) Given the nature of the present invention, secured access to the web site is preferred. Such access could be via any of the standard password-type access protocols available today, or via a biometric secured-access methodology.

Authorized user database file 240 preferably includes, for each firearm 100 that has been trained, at least one authorized user web print. As will be discussed below, the server preferably stores a series of web prints for each authorized user. For each authorized user, database file 240 also preferably includes a user ID, the user's name, social security number, address, information concerning the firearm such as brand and type, the serial no. of the firearm, and information concerning the dealer who sold the firearm (e.g., dealer ID, name, location, and the user ID of the individual at the dealer who accessed the web site during the training and/or registration of the firearm), and the ID of the training computer that was utilized to train and/or register the firearm.

Unauthorized user database 250 preferably includes, for each type of firearm, a relatively large number of "unauthorized" user web prints. These web prints are gathered by individuals physically grasping the type of firearm in question such that the biometric authorization system 105 in the firearm detects the relevant biometric information. This web print information is then preferably stored in unauthorized user database 250. Such collecting and storing of biometric information may be accomplished via the training computers 125 and/or at the server 200. In the preferred embodiment, hundreds or even thousands of unauthorized user web prints are collected and stored for each type of firearm 100. These web prints are preferably from individuals of various ages, sexes, build, etc. to represent the effectively infinite number of potential unauthorized individuals. When training the biometric authorization system in an authorized user's firearm, the server may also use as unauthorized prints the authorized prints that were previously obtained by the system when training the same type of firearm for other users.

Firearm information 260 preferably includes information on each type of firearm handled by the system such as brand and type. It may also include further information such as a listing of serial numbers manufactured by the manufacturer of the firearm.

Firearm dealer information 270 preferably includes for each dealer handled by the system, the name of the dealer, a dealer ID, user ID(s) and associated password or equivalent access information for those individuals who have access to the server, address information, and training computer ID(s) for those training computer(s) at the dealer.

Training computer database information 280 preferably includes for each training computer in the system a training computer ID and location information for the training computer.

Figure 4:
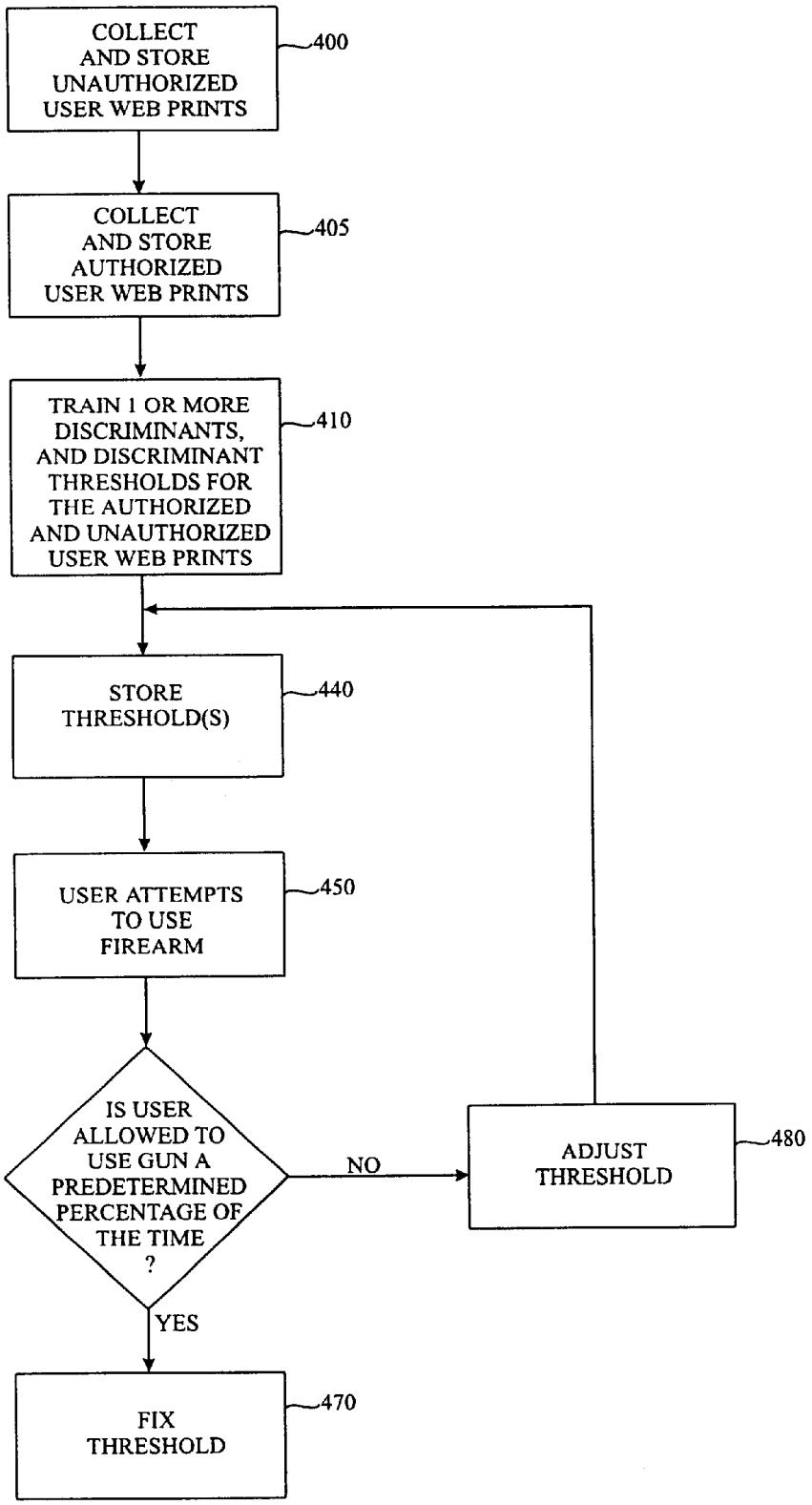
FIG. 4 is a flowchart that illustrates a method of training a biometric authorization system in a firearm to accurately discriminate between an authorized user and unauthorized users.

The preferred method by which the biometric authorization systems 105 in firearms 100 is programmed to accurately discriminate between authorized and unauthorized users will now be described with reference to FIG. 4. As illustrated by step 400, the system collects and stores unauthorized user web prints. These web prints are collected and stored for each type of firearm administered by the system. In the preferred embodiment, the unauthorized user web prints are stored at server 200 in database file 250; but as explained above, such prints could also be stored at a training computer 125.

As illustrated by step 405, the system collects and stores at least one web print from the authorized user. In the preferred embodiment, however, the authorized user is instructed to repeatedly grasp the firearm such that the system collects and stores a series of web prints for the authorized user. Recording multiple web prints for the authorized user is preferable because, like skin elsewhere on the hand, the web is relatively plastic. In addition, the web of the authorized user may not be placed in exactly the same place on the handle of the firearm each time he picks up the gun. The multiple recordings are preferably spaced about in time. This will allow the authorized user to relax his hand between recordings, and thus simulate the user picking up the firearm at different times. The web prints collected by the system are preferably stored at server 200 in database file 240. But, as explained above, such prints could also be stored at a training computer 125.

In the preferred embodiment, the server collects the authorized web prints in step 405 as follows. First, an individual at the firearm dealer (or some other location where a training computer is located) logs onto the web site provided by server 200, provides his password or other access information, and (if authorized by the server) is provided access to the web site. The individual then preferably enters the authorized individual's name, social security number, and address information on a web page provided by the server and displayed on training computer 125. Information regarding the brand name of the firearm, the type of firearm, and serial number information is also preferably entered on the web page. (In one embodiment, the relevant firearm information such as brand name, type, and serial number is stored by the manufacturer of the firearm such that the information may be transmitted directly to the server, or transmitted to the training computer so as to allow that information to be entered on the web page.) The user and firearm information is then transmitted to the server, which creates a database file for the authorized user. If the firearm 100 has not already been connected to the training computer 125, it is connected such that the firearm may transmit biometric information measured by the biometric authorization system 105 in the firearm to the server computer 200. The authorized user then preferably repeatedly grasps the handle of the firearm in the manner described above, and the server collects and stores the user's web prints.

After the server has stored the user's web prints, it trains one or more discriminants for the authorized user and the unauthorized users (step 410). Discriminants are numbers that are computed from measured data. Here, the measured data represents biometric information. Discriminants are generally computed using an input data set and a set of parameters. The server trains the one or more discriminants by computing the best set of parameters to discriminate between the two sets of data (the authorized user biometeric information and the unauthorized user biometric information). There are a variety of means for training discriminants.

In the preferred embodiment, however, the process is as follows. First, the server utilizes the series of authorized user web prints that were previously obtained, rather than just one web print. These web prints are used to represent the possible translations in the authorized user's web pattern. The goal is to recognize whether the user's print can be more properly assigned to the set of instances (translations) belonging to the authorized user, or to the set of instances belonging to unauthorized users. It is not important which of the authorized user web prints the new print most approximates.

The server thus utilizes two sets of web prints in the preferred embodiment. Set A is comprised of the series of authorized user web prints obtained during the training period. Set B is preferably a set of unauthorized web prints for the same type of firearm that were previously obtained by the server.

Principal component analysis is preferably utilized to convert the data representing the authorized and unauthorized user web prints into one or more trained discriminants. In order to train a first linear discriminant, the pixels of the images representing each of the web prints can be arranged in any order so that each pixel has a number. The string of pixels representing each of the imaged web prints can be regarded as a vector, as is well known in the art. This vector, for purposes of this discussion will be referred to as vector x. The server computes a weight vector w such that the inner product between x and w is a good discriminant between the authorized user's web prints (Set A) and the unauthorized user web prints (Set B).

By convention, the vector x is a column of numbers. Its transpose $x^T$ is a row of numbers:

$$x^T = x_1, x_2, \ldots, x_N,$$

where N is the number of pixels detected. Again, this is just a list of detected values in a well-defined order. The weight vector can be written as:

$$w^T = w_1, w_2, \ldots, w_N.$$

The inner product, which can be written as $$d = x^T w = x_1 w_1 + x_2 w_2 + \ldots + x_N w_N,$$

is called a linear discriminant. The server attempts to compute the weight values in such a way that, e.g., Class A instances tend to give positive d and Class B objects tend to give negative d; i.e., d=0 might be a threshold such that values in excess of 0 indicate the authorized user and values below 0 indicate an unauthorized user. If after training a first linear discriminant ($d_1$), the server determines that the discriminant does not sufficiently discriminate between the web print(s) of the authorized user and the unauthorized user web prints, a second linear discriminant ($d_2$) is trained. Referring to the weight vector in the first linear discriminant as $w_1$, a second weight vector $w_2$ is preferably computed by the server such that $w_1$, and $w_2$ are independent (i.e., orthogonal). In other words, $w_1$, and $w_2$ use the information in the x vectors in independent ways and the information in the second discriminant is totally independent from the information in the first. The server selects the second discriminant to be the best of a set of data points on the plane orthogonal to wl. The server computer 200 analyzes the two training sets of linear discriminants ($d_1$ and $d_2$) in two-dimensional space ($w_1$–$w_2$). If it determines that the two training sets of linear discriminants separate well in that space (e.g., if a Gaussian probability distribution function (i.e., a threshold) can be computed that separates the discriminant data points for the authorized user web prints from the discriminant data points from the unauthorized user web prints), the server stops. If not, the server computes a third weight vector such that it is independent of (i.e., orthogonal to) both $w_1$ and $w_2$. The server then plots the data in 3D space ($w_1$–$w_2$–$w_3$.). If necessary, the computer continues this process.

The server may compute the weight vectors by a variety of well known means. For instance, http://fonsg3.let.uva.nl/praat/manual/Principal—component—analvsis.html (which is hereby incorporated by reference) describes a means whereby the ratio of between-class distance (the distance between data points representing the set of authorized web prints and the set of data points representing the unauthorized web prints) to within-class variation is optimized by means of eigenvector analysis. A detailed description of that process is not included here because it is well known in the art.

While in the preferred embodiment, the one or more trained discriminants are computed from the pixel data signals that resulted when the authorized individual grasped the gun, the server could process that data before training the discriminants. For example, the pixel data could be normalized and possibly binarized as well. Additional image processing could also be done prior to training the discriminants. For example, the server could process the data such that it is generally invariant to the orientation and/or translation of the web print. One such way of accomplishing this is by computing the Fourier transform of the received web print data so as to produce a data pattern that is invariant in shape to input translation. Such a translation changes only the phase information encoded in the web print pattern. By extracting the amplitude of the Fourier transform, the server computes a web print pattern that is characteristic of the user's web print, but which is invariant to translation.

Other methods of training linear discriminants are also available to those skilled in the art and are contemplated to fall within the scope of the present invention.

The server may also train non-linear discriminants in order to train the biometric authorization systems 105 in the firearms 100. A preferred method of training non-linear discriminants is via the use of Support Vector Machines (SVM), a well known biometric analysis technique. A description of SVM is found in an ISIS Technical Report entitled "Support Vector Machines for Classification and Regression" by Steve Gunn, May 14, 1998, which is hereby incorporated by reference. Further information on Support Vector Machines may be found at http://svm.research.bell-labs.com/SVMrefs.htmI or http://svm.first.gmd.de/ or http://open.brain.riken.go.jp/back/webpapers/svm/svm.html or http://www.isis.ecs.soton.ac.uk/research/svm/, all of which are also incorporated by reference.

When training the one or more discriminants in step 410, the server computes one or more discriminant thresholds associated with the discriminants that will allow the biometric authorization system 105 in the firearm to accurately and reliably discriminate between the authorized user and unauthorized users. These thresholds may be linear thresholds or any other type of threshold.

Figure 5:
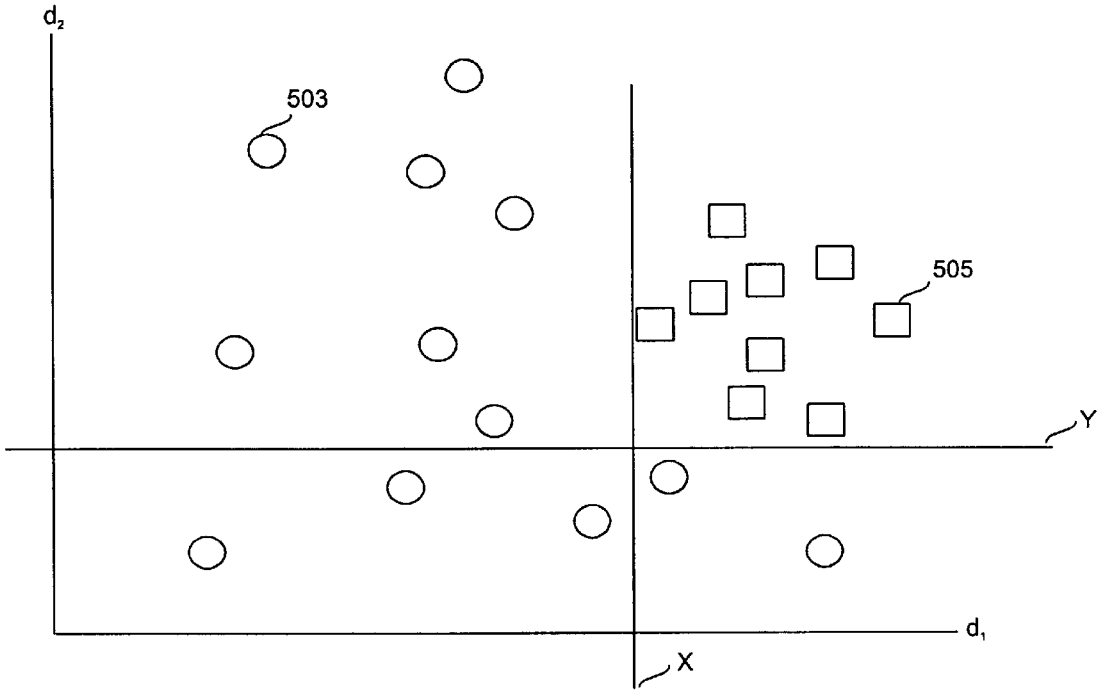
FIGS. 5 and 6 are diagrams showing illustrative discriminant thresholds that may be computed according to the present invention.
Figure 6:
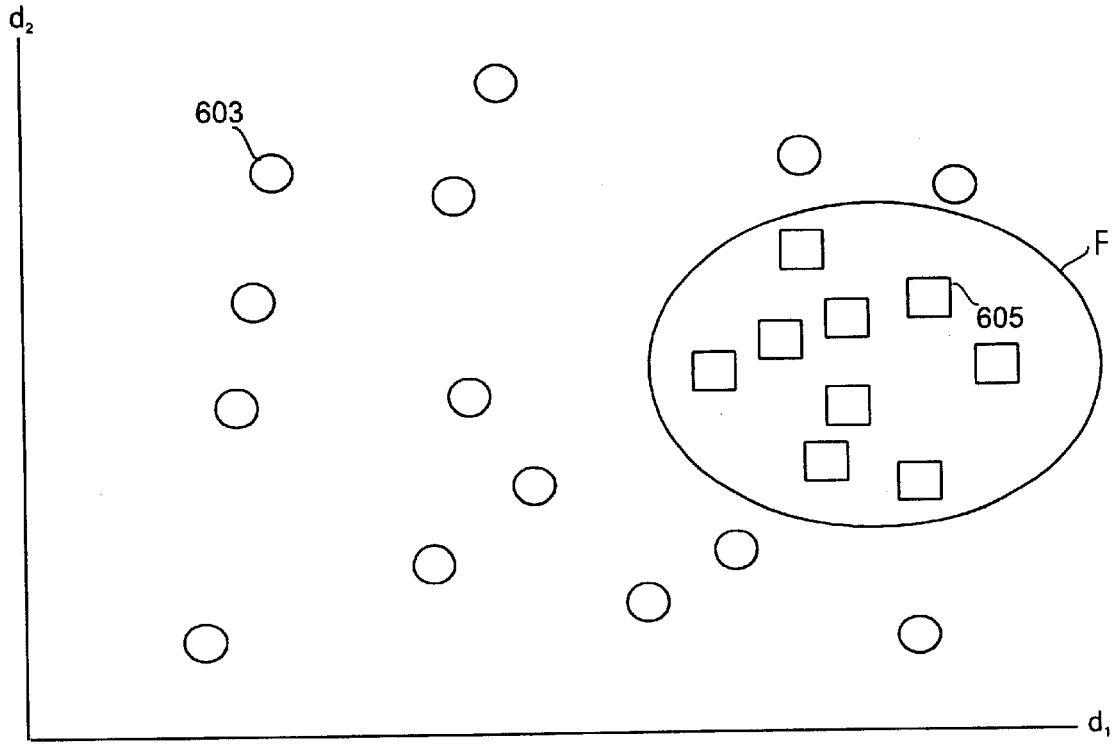

FIGS. 5 and 6 show illustrative (and simplified-for-the-purpose-of-discussion) thresholds that the server may compute in training the discriminants. In the example of FIG. 5, the computer has trained two linear discriminants ($d_1$ and $d_2$). The circle data points 503 represent computed discriminant values for the authorized set of web prints, and the square data points 505 represent the computed discriminant values for the set of unauthorized web prints. The computer has computed two linear thresholds X and Y to discriminate between the authorized web prints and the unauthorized web prints. In the example of FIG. 6, the server has computed two linear discriminants ($d_1$ and $d_2$), and computed a threshold F to discriminate between the set of authorized user web prints and the set of unauthorized web prints. It should be noted that in the preferred embodiment many more authorized and unauthorized user web prints would be analyzed by the server in training the discriminants and in calculating the thresholds.

After the discriminants and threshold(s) have been trained, the server transmits to memory 111 in firearm 100 the trained discriminant(s) along with the corresponding discriminant thresholds. The authorized user then repeatedly attempts to operate the firearm (step 450); and, using the trained discriminant(s) stored in memory 111, the biometric authorization system 105 in the firearm computes discriminant values for the detected biometric information and compares them against the stored threshold(s). If the authorized user is allowed to operate the firearm a predetermined percentage of the time, the threshold(s) in memory 111 of the firearm 100 are fixed (step 470). If the authorized user is not allowed to operate the firearm a predetermined percentage of the time, the server adjusts the threshold(s) (step 480), and transmits the new threshold(s) to memory 111, and steps 450 and 460 are repeated.

Figure 7:
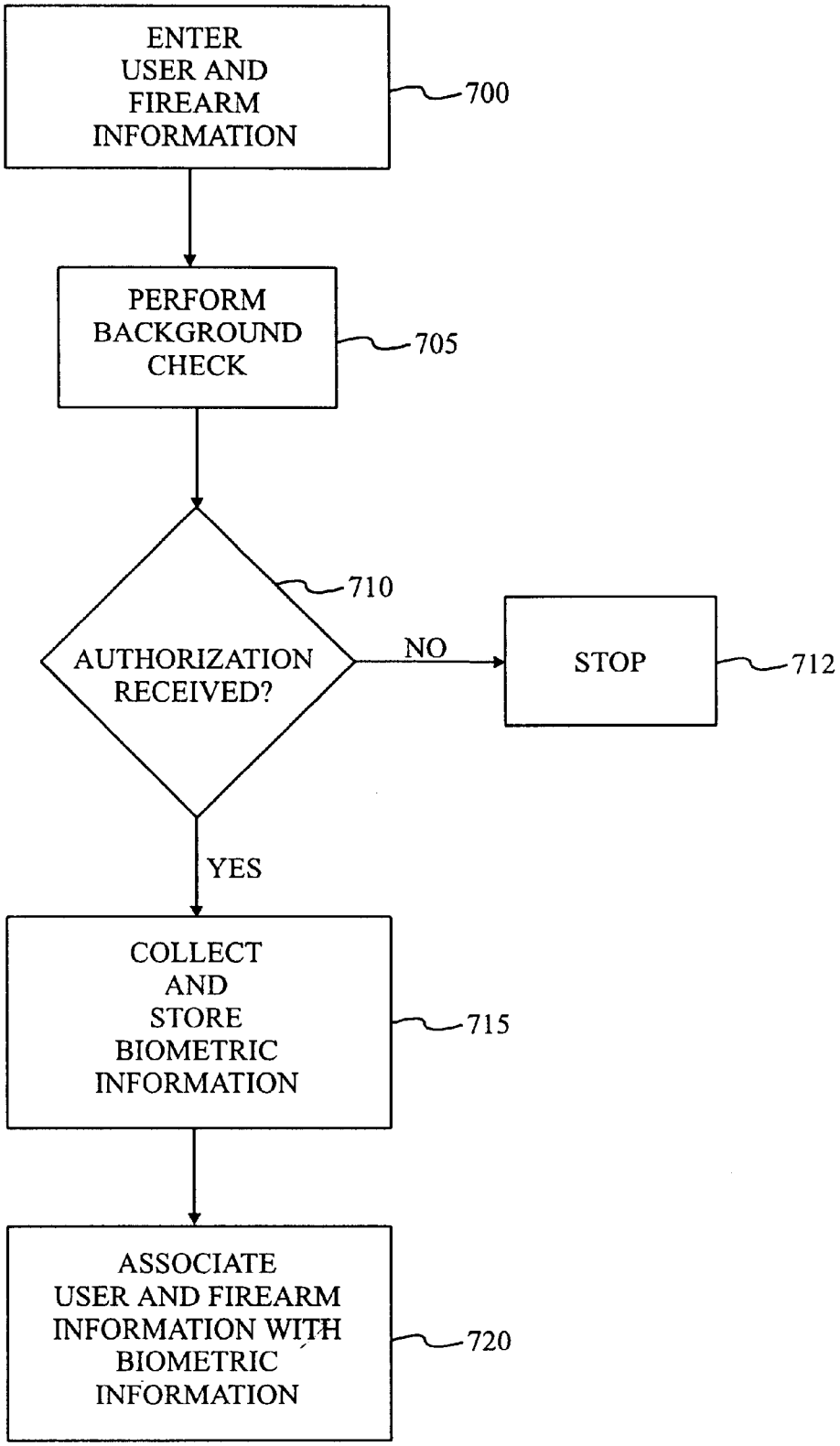
FIG. 7 is a flowchart that illustrates a method of uniquely registering a firearm with an authorized user.

As indicated above, the system of the present invention may also be used to uniquely register the firearm with the authorized user. A preferred method of uniquely registering the firearm with the user is illustrated in FIG. 7. First, the system collects and stores information regarding the firearm and the authorized user. This is preferably done as follows. An individual at the firearm dealer (or some other location where a training computer is located) logs onto the web site 230 provided by server 200, provides his password or other access information, and (if authorized by the server) is provided access to the web site. The individual then preferably enters the authorized individual's name, social security, and address on a web page provided by the server 200 and displayed on training computer 125. Information regarding the brand name of the firearm, the type of firearm, and serial number information is also preferably provided on the web page. (As discussed above, in one embodiment, the relevant firearm information such as brand name, type, and serial number is stored by the manufacturer of the firearm so that such information may be transmitted directly to the server, or transmitted to the training computer so as to allow that information to be entered on the web page.) This information is then transmitted to the server, which creates a database file for the authorized user in file 240.

In the preferred embodiment, the server then utilizes the transmitted user information to perform a background check (step 705) to determine whether the user may purchase or be authorized by the system to operate the firearm. Criminal (and possibly other relevant) record information may be stored at the server 285 so as to allow the server to perform the background check. Such information could also be stored at another location and accessed by the server via a communication network, or the server could communicate the user information to another computer that performs the background check and transmits the results to the server. In any event, if the background check indicates that the user may not purchase or operate the firearm, the registration process quits, as illustrated by step 712. If the background check result indicates that the user may purchase or be allowed to operate the firearm, the server preferably then collects and stores at least one web print of the authorized user, as illustrated by step 715. The server then electronically associates the web print with the user and firearm information obtained in step 700. By including the user's biometric information with the firearm and the user's other information (such as name, social security number, etc.), the firearm is uniquely associated with the authorized user and the possibility of fraud is reduced.

In some jurisdictions a background check may not be required. If that is the case, steps 705 and 710 are not necessary and may be skipped. Those of ordinary skill will also recognize that the order of some of the registration steps may be varied. By way of example and not limitation, the system may also collect and store the user's web print (or other biometric information) before performing the background check at step 705. Such biometric data could then also be utilized during the background check to determine if the user's biometric data matches any biometric information of those previously found at a crime scene, etc. Those of ordinary skill will also recognize that the registration method may be incorporated within the biometric authorization system training methodology of the present invention.

While the training algorithm discussed above in connection with FIGS. 1 and 4 has focused on training a biometric authorization system in a firearm, it should be understood that a similar methodology could also be employed to authorize use of or entry to other products, services, or spaces where a portion of the user's hand comes in contact to a system or device having a biometric authorization system. In the preferred embodiment, the sensor of the biometric authorization system is placed in a location of the system or device where the would-be user's hand comes in regular contact with the system or device. For example, the unique training methodology described in connection with FIG. 4 could also be utilized to train a biometric authorization system attached to a door handle or door knob, a steering wheel or other device in or on a vehicle, or a mouse or other device that grants access to a computer or computer network. In the training methodology for such systems, steps 450–470 would be similar except that the system would detect whether the system or device was authorized a predetermined percentage of the time. Like the firearm embodiment, the unauthorized web prints could be stored locally at a training computer, or remotely at a server.

While the present invention has been described with reference to the preferred embodiments, those skilled in the art will recognize that numerous variations and modifications may be made without departing from the scope of the present invention. This is especially true with regard to the presentation of information and configuration of the information entered and displayed on web pages, which may be varied greatly without departing from the scope of the present invention. Moreover, while a preferred embodiment regarding the system architecture of the present invention has been disclosed in connection with FIGS. 1–3, in view of the foregoing description, other system architectures that can carry out one or more of the methods of the present invention may also be available, and all such other system architectures are contemplated to be within the scope of the present invention. For example, from the description of the database files in server 200, those skilled in the art will recognize that other database structures could be used, and all such database structures are contemplated to be within the scope of the present invention. It should also be noted that the operation of and the components comprising the server could be divided among a number of computer devices. Accordingly, it should be clearly understood that the embodiments of the invention described above are not intended as limitations on the scope of the invention, which is defined only by the claims that are now or may later be presented.

What is claimed is:

1. A system for programming a biometric authorization system in a first firearm utilized to discriminate between an authorized user of the first firearm and unauthorized users of the first firearm, comprising:

a) means for collecting and storing a large number of unauthorized user web prints by having the unauthorized users grasp a firearm;

b) means for collecting and storing at least one authorized user web print by having the authorized user grasp a firearm;

c) means for training one or more discriminants for the at least one authorized user web print and at least some of the unauthorized user web prints;

d) means for computing one or more discriminant thresholds based on the step of training the discriminants; and e) means for transmitting to the first firearm the one or more trained discriminants and one or more discriminant thresholds.

2. The system of claim 1, further comprising means for adjusting the one or more discriminant thresholds and transmitting the adjusted thresholds to the first firearm in response to receiving a message indicating that the authorized user is unable to operate the first firearm a predetermined percentage of the time.

3. The system of claim 1, wherein the means for collecting and storing authorized user web prints collects and stores a series of web prints from the authorized user.

4. The system of claim 1, wherein the system comprises a server that is constructed so as to be remotely connected to the first firearm via a communications network.

5. A method of programming a biometric authorization system in a first firearm to discriminate between an authorized user of the first firearm and unauthorized users of the first firearm, comprising:

a) collecting and storing at a computer a large number of unauthorized user web prints from the unauthorized users by having the unauthorized users grasp a firearm;

b) collecting and storing at the computer at least one authorized user web print from the authorized user by having the authorized user grasp a firearm;

c) training at the computer one or more discriminants for the at least one authorized user web print and at least some of the unauthorized user web prints;

d) calculating at the computer one or more discriminant thresholds based on the step of training the discriminants; and e) transmitting from the computer to the first firearm the one or more trained discriminants and discriminant thresholds.

6. The method of claim 5 further comprising the step of adjusting the one or more discriminant thresholds and transmitting the adjusted thresholds to the first firearm in response to receiving information that the authorized user is unable to operate the first firearm a predetermined percentage of the time.

7. The method of claim 5, wherein the step of collecting and storing at least one authorized user web print includes the step of collecting and storing a series of web prints from the authorized user.

8. The method of claim 5, wherein the step of computing one or more discriminants comprises the steps of:

(a) training a first discriminant;

(b) determining whether the first trained discriminant sufficiently discriminates between the series of authorized user web prints and the unauthorized user web prints; and (c) if the first trained discriminant does not sufficiently discriminate between the series of authorized user web prints and the unauthorized user web prints, training a further discriminant.

9. A method of programming a biometric authorization system in a first firearm to discriminate between an authorized user of the first firearm and unauthorized users of the first firearm, comprising:

a) collecting and storing at a computer a large number of unauthorized user web prints from the unauthorized users by having the unauthorized users grasp a firearm;

b) collecting and storing at the computer at least one authorized user web print from the authorized user by having the authorized user grasp a firearm;

c) training at the computer one or more discriminants for the at least one authorized user web print and at least some of the unauthorized user web prints;

d) calculating at the computer one or more discriminant thresholds based on the step of training the discriminants;

e) transmitting from the computer to the first firearm the one or more trained discriminants and thresholds;

f) allowing the authorized user to attempt to operate the first firearm;

g) if the authorized user is not allowed to operate the first firearm a predetermined percentage of the time, adjusting the one or more thresholds at the computer and transmitting the thresholds from the computer to the first firearm;

h) repeating steps e-g until the authorized user is allowed to operate the first firearm the predetermined percentage of the time.

10. The method of claim 9, wherein the computer is a server that is remotely connected to the first firearm via a communications network.

11. A firearm comprising:

means for storing one or more trained discriminants and associated one or more discriminant thresholds, the discriminants formed by analysis of the authorized user biometric information and a large number of unauthorized user biometric information;

means for sensing biometric information;

means for computing one or more discriminant values based on the sensed biometric information and the trained discriminants;

means for comparing the computed one or more discriminant values with the stored one or more discriminant thresholds; and means for authorizing or not authorizing the use of the firearm.

12. A method of uniquely associating a first firearm with an authorized user comprising:

a) collecting and storing at a computer a large number of unauthorized user web prints from the unauthorized users by having the unauthorized users grasp a firearm;

b) receiving at the computer authorized user information and first firearm information;

c) collecting and storing at the computer at least one web print from the authorized user by having the authorized user grasp a firearm;

d) training at the computer one or more discriminants for the at least one authorized user web print and at least some of the unauthorized user web prints;

e) calculating at the computer one or more discriminant thresholds based on the step of training the discriminants;

f) transmitting from the computer to the first firearm the one or more discriminants and thresholds;

g) electronically associating at the computer the user and first firearm information with the at least one authorized user web print.

13. The method of claim 12 wherein the computer is a server that is remote from the user and the first firearm.

* * * * *